US006507722B2

(12) United States Patent
Okamura et al.

(10) Patent No.: US 6,507,722 B2
(45) Date of Patent: Jan. 14, 2003

(54) DEVELOPING DEVICE

(75) Inventors: Takehiko Okamura, Nagano-ken (JP); Hidenori Kin, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/853,660

(22) Filed: May 14, 2001

(65) Prior Publication Data

US 2002/0009313 A1 Jan. 24, 2002

(30) Foreign Application Priority Data

May 30, 2000 (JP) ..... 2000-160386
May 12, 2000 (JP) ..... 2000-140353
May 12, 2000 (JP) ..... 2000-140354

(51) Int. Cl.[7] ..... G03G 15/08
(52) U.S. Cl. ..... 399/286
(58) Field of Search ..... 399/286, 265, 399/267, 279, 274, 284

(56) References Cited

FOREIGN PATENT DOCUMENTS

JP 2-26226 * 6/1990 ..... G03G/15/08
JP 5-046008 * 2/1993
JP 6-46331 * 6/1994 ..... G03G/15/08
JP 7-72734 * 3/1995 ..... G03G/15/08
JP 2001-242660 * 7/2001

OTHER PUBLICATIONS

Abstract. JP 06–46331. Jun. 15, 1994.*
Abstract. 07–72734. Mar. 17, 1995.*

* cited by examiner

*Primary Examiner*—Quana M. Grainger
(74) *Attorney, Agent, or Firm*—Sughrue Mion, PLLC

(57) ABSTRACT

A developing device according to the present invention comprises an image developing roll 4 having a roll surface treated with sand blast treatment to form a rough surface morphology in which aluminum anodizing is also applied to the surface of the image developing roll 4 where the rough surface morphology is formed. To the image developing roll 4 is applied a development bias consisting of a direct current voltage overlapped with an alternate current voltage. In this arrangement, the image developing roll 4 can perform the functions of conveying developer, charging developer, and preventing of discharge of the developing bias, while the image developing roll 4 can be manufactured from a metallic roll such as aluminum roll at a low cost. Moreover, a gradual scraping of the image developing roll 4 surface by external additives of toner 3 suppresses adhering of toner 3 onto the surface of the image developing roll 4, preventing the occurrence of filming.

11 Claims, 7 Drawing Sheets

DEVELOPING DEVICE

BACKGROUND OF THE INVENTION

The present invention relates to a technical field of a developing device used in image forming apparatus such as electrophotographic copiers and printers and, more particularly, to a technical field of a developing device comprising an image developing roll for carrying developer and conveying it to a latent image carrier.

In conventional image forming apparatus such as electrophotographic copiers and printers, an image is obtained by developing an electrostatic latent image on a latent image carrier such as photoreceptors by means of developer of a developing device, transferring the developed image from the latent image carrier to a recording medium such as paper, and finally fixing the transferred image to the recording medium.

Among conventional developing devices used in such image forming apparatus, there is a type of developing device which employs a contact development system in which an image developing roll carrying a developer and conveying it to a latent image carrier is in contact with the latter. In a developing device employing the contact development system, the image developing roll in contact with the latent image carrier conveys charged monocomponent developer to the latent image carrier, to develop the electrostatic latent image on the latent image carrier with the monocomponent developer. There are other type of conventional developing device which at least comprises an image developing roll for carrying developer and conveying it to a latent image carrier, and a regulating member which is in contact with the image developing roll and regulates the developer being conveyed to the latent image carrier in such a manner that a thin layer of developer is formed on the image developing roll surface. In such a developing device, electrically charged monocomponent developer which is regulated by the regulating member to form a thin layer of the developer on the image developing roll surface is conveyed by the image developing roll to the latent image carrier, thus developing with the thin-layered monocomponent developer an electrostatic latent image on the latent image carrier.

In this respect, a metallic roll made of aluminum or iron is used as image developing roll. Particularly, aluminum roll is commonly used because of its excellent workability and low cost.

The functions required to an image developing roll of a developing device are: (1) property for conveying developer, (2) property for charging developer, and (3) property for preventing the discharging of developing bias.

In order to improve the properties for conveying and charging of developer, a carrier roll (i.e. an image developing roll) is proposed in Japanese Patent Publication No. H6-46331, in which a metallic roll is subjected to a sand blast treatment so that a rough surface morphology is imparted to the roll surface, which is then plated with metal such as nickel. According to the carrier roll disclosed in the publication, the rough surface morphology formed on the carrier roll mechanically increases the developer conveying property of the roll, while also improving the developer charging property of the roll because of increased contact area for developer. By metal plating the rough surface of the metallic roll, the abrasion resistance of the roll is improved.

In order to prevent the discharging of the developing bias, a roll having a specific resistance set at a predetermined value has been proposed. For instance, proposed in Japanese Patent Publication No. H2-26226 is a carrier for a non-magnetic monocomponent toner (that is, an image developing roll) comprising a cylindrical rigid body made of a resin having conductive powder dispersed therein with a specific resistance value in a range of $10^4$ to $10^{12}$ W cm in which the cylindrical rigid body has a conductive layer formed on an inner surface thereof or a conductive paint coating with a specific resistance value not exceeding $10^7$ W cm formed on the inner surface thereof. Further, proposed in Japanese Patent No. 2705090 is a carrier for a non-magnetic monocomponent toner (that is, an image developing roll) comprising a semiconductive layer formed on its surface, the layer being formed of ceramics such as alumina, having a specific resistance value in a range of $10^4$ to $10^{12}$ W cm and a thickness of 100 to 1000 mm. By using the carriers for non-magnetic monocomponent toner disclosed in the above mentioned publications, the discharging of the developing bias can be effectively prevented to prevent the occurrence of image defects, owing to the fact that at least the roll surface has a predetermined specific resistance value.

Meanwhile, as disclosed in above described Japanese Patent Publication No. H2-26226 and Japanese Patent No. 2705090, it is a conventional practice to use a direct current voltage overlapped with an alternate current voltage as a developing bias in a developing device in order to prevent background toning, to obtain an adequate edge effect, and to improve the gradation.

However, in the carrier roll disclosed in Japanese Patent Publication No. H6-46331, a metal plating is applied onto the roll surface which has been roughened by sand blast treatment. The metal plating comes to blur the clear morphology of the roll surface formed by sand blast treatment, in such a manner that sharp ridges bounding the adjacent recesses are rounded by overlaid plating material. Therefore, there is a problem that the effect of the rough surface morphology formed by sand blast treatment to improve the conveying property and charging property of the roll cannot be fully and reliably obtained because of the blurring of the clear surface morphology by the subsequent metal plating, although the metal plating increases the abrasion resistance of the roll surface.

Further, the carrier roll formed of a resin having conductive powder dispersed therein, disclosed in Japanese Patent Publication No. H2-26226, has a problem that it can yield mottling in the developed image because of possible uneven distribution of the conductive powder dispersed in the resin, which leads to uneven specific resistance value over the roll surface.

Furthermore, the toner carrier roll having ceramic semiconductive layer with a thickness of 100 to 1000 mm has a problem of manufacturing difficulty and cost, since the semiconductive layer is formed by spraying ceramic material melted by arc discharging, onto the toner carrier substrate.

It is conceivable to combine the technical items described in foregoing publications so that the roll can be reliably provided with the foregoing three functions. However, such combinations of technical items described in the publications for imparting the foregoing three functions to the roll can bring about following problems.

Namely, a combination of techniques of Japanese Patent Publications No. H6-46331 and No. H2-26226 means that the carrier roll is not a metallic one, but is formed of resin having conductive powder dispersed therein. There is a problem that such a carrier roll is difficult to sand blast to form a rough surface as described in Japanese Patent Publication No. H6-46331, and it is also difficult to improve its abrasion resistance by some treatment. Therefore, the combination of techniques of Japanese Patent Publications No. H6-46331 and No. H2-26226 in such a manner that the image developing roll can perform the foregoing three functions reliably is extremely difficult.

A combination of Japanese Patent Publication No. H6-46331 and Japanese Patent No. 2705090 means that a layer of ceramic semiconductive material melted by arc discharging according to Japanese Patent No. 2705090 is formed on a rough surface formed according to Japanese Patent Publication No. H6-46331. This will lead to a blurred surface morphology in such a manner that sharp ridges bounding adjacent recesses are rounded by overlaid material, as is the case in metal plating of the rough surface described in Japanese Patent Publication No. H6-46331. Therefore, the combination of techniques of Japanese Patent Publications No. H6-46331 and No. 2705090 in such a manner that the image developing roll can perform the foregoing three functions reliably is extremely difficult.

Further, the developing devices described in the above described publications employ non-contact development system which cannot be applied as it is to the contact development system, in which an image developing roll is in direct contact with a latent image carrier.

Furthermore, in all development devices described in above described three publications, a regulating member for forming a thin toner layer is in contact with an image developing roll. This type of developing device has a problem that a part of toner which is not conveyed to the latent image carrier because of regulation by the regulating member adheres to the image developing roll surface, which leads to the occurrence of a filming.

SUMMARY OF THE INVENTION

The present invention has been achieved in the light of the above described problems, and it is an object of the present invention to provide a developing device having an image developing roll capable of performing more reliably the above described three functions of conveying developer, charging developer, and preventing discharging of developing bias, and also to provide a developing device of which image developing roll can be manufactured easily at a low cost.

It is another object of the present invention to provide a developing device having an image developing roll which can prevent the filming, and which can be manufactured easily at a low cost.

It is further object of the present invention to provide a developing device in which foregoing problems can be solved by anodizing of an image developing roll, while omitting or facilitating a special treatment for sealing minute holes formed in anodizing of the image developing roll.

In order to achieve these objects, the present invention provides a developing device comprising at least: an image developing roll which can carry developer on its peripheral surface and can convey it to a latent image carrier; and a regulating member which can regulate the developer to be conveyed to said latent image carrier and can form a thin layer of developer on the image developing roll, characterized in that said image developing roll is composed of a metallic roll having, a rough surface morphology formed by sand blast treatment at least in the developer carrying region of the roll surface, and that anodizing is applied at least to the part of the surface where the rough surface morphology is formed.

Further, the present invention provides a developing device comprising at least an image developing roll which can carry developer on its peripheral surface and convey it a latent image carrier, characterized in that said image developing roll is composed of a metallic roll having a rough surface morphology formed by sand blast treatment at least in the developer carrying region of the roll surface, and that anodizing is applied at least to the part of the surface where the rough surface morphology is formed.

The developing device according to the present invention is further characterized in that said developer is composed of developer particles and external additives with a predetermined hardness adhering to the former, and that the hardness of the surface of said metallic roll is set to be lower than the hardness of said external additives.

The developing device according to the present invention is further characterized in that said developer is non-magnetic monocomponent toner.

The developing device according to the present invention is further characterized in that the particle diameters of said external additives are set to be smaller than the diameters of minute holes existing in the oxidation layer formed by said anodizing.

The developing device according to the present invention is further characterized in that the liberation ratio of said external additives is set to be 2% or more.

The developing device according to the present invention is further characterized in that the sphericity of said developer particles is set at 0.9–1 expressed in Wadell's practical sphericity value.

The developing device according to the present invention is further characterized in that the peripheral speed of said image developing roll is set to be higher than the peripheral speed of said latent image carrier.

In the developing device having the aforementioned constitution according to the present invention, at least developer carrying region of the surface of the metallic roll composing the image developing roll has a clear surface morphology formed by the sand blast treatment, in which sharp ridges bound adjacent recesses. This roughened region of the metallic roll surface is subsequently subjected to anodizing, in which an oxidation layer is formed on the roughened surface. In this respect, most of the electrolysis reaction occurs penetrating into the metallic roll substance, so that the thickness of the oxidation layer formed at the surface is very thin. Therefore, the formation of the oxidation layer at the metallic roll surface hardly influences the surface morphology, such that the rough surface morphology formed in the sand blast treatment is mostly preserved after anodizing. Thus, the ridges bounding the adjacent recesses can be clearly formed, and the roll can reliably exhibit the developer conveying property because of the edge effect of the roughened surface.

Preserving of sharp ridges in the surface morphology formed by the sand blast treatment also increases the contact area between the image developing roll and developer particles. By this, the friction between the image developing roll surface and developing particles is sufficiently promoted such that the developer particles are effectively friction charged. Thus, the developer charging property of the image developing roll can be improved. Particularly, in a developing device employing a non-contact developing system in which the image developing roll is not in contact with the latent image carrier, the improvement in developer conveying property and in developer charging property brings about a decrease of toner scattering.

In addition, the oxidation layer formed by anodizing hardens the surface of the image developing roll, improving both abrasion resistance and mechanical strength of the image developing roll. In this respect, the hardness of the image developing roll surface can be further increased by performing the treatment slowly in an electrolysis solution kept at relatively low temperature.

This oxidation layer has a cellular structure consisting of a thick porous layer with many minute holes and a dense and very thin active layer. In this respect, the active layer has a certain electric resistance such that a metallic roll having a relatively low electric resistance comes to have a predetermined electric resistance, because of the resistant layer formed at the roll surface by anodizing. An uniform electric resistance can be obtained over the anodic-oxidized part of the metallic roll surface, since the anodic oxidation occurs uniformly over the treated surface of the metallic roll. Thus, an image developing roll can be formed easily at a low cost, from a metallic roll having an uniform electric resistance of a predetermined value, requiring no special electrically resistant material for the manufacture of the image developing roll.

The image developing roll having an uniform electric resistance of a predetermined value can prevent the injection of excess charge from developing bias to developer. This effect is particularly important in a developing device employing a contact developing system, in which a large pressure exerted by developer particles nipped between a latent image carrier and an image developing roll promotes the injection of excess charge to developer.

Further, by setting the hardness of the metallic roll surface to be lower than the hardness of external additives of toner according to the present invention, an effect is obtained that the rough surface of the image developing roll is scraped or broken little by little by the abrasion with the external additives of toner, the effect suppressing the adhering of toner onto the image developing roll surface, thereby effectively preventing the occurrence of filming. This effect is particularly important in a developing device employing a contact developing system in which a regulating member is in contact with an image developing roll, and the toner is prone to adhere at the location where the regulating member touches the image developing roll surface. This gradual breaking or scraping of the rough surface of the image developing roll by external additives of toner is however so little by little that the abrasion resistance of the image developing roll is maintained, ensuring an uniform toner conveyance and an appropriate toner charging.

In addition, a gradual breaking of the ridges in the rough surface morphology of the image developing roll leads to the formation of new ridges in the surface morphology.

The oxidation layer on a roll surface treated with anodic oxidation has many minute holes, which not only attract: foreign materials but make the roll surface susceptible to corrosion, resulting in deteriorated developing effect. Therefore, a sealing treatment is required in order to deactivate the holes to improve the stability of the roll surface against environment. On the other hand, a non-magnetic monocomponent toner used in the present invention is composed of toner mother particles and external additives adhering to the former. In this respect, not entire external additives are attached to the mother particles but a part of them exist liberated from the mother particles. Since according to the present invention, the particle diameters of external additives are set to be smaller than the diameters of the minute holes, the external additives can be embedded in the minute holes during toner is carried and conveyed on the image developing roll surface, thus sealing the many minute holes with external additives. In this manner, the sealing of the minute holes can be achieved automatically by means of the liberated external additives of toner during the toner conveying.

Therefore, a special treatment for sealing the many minute holes are not required, or even if the special sealing treatment is required, the treatment can be simplified because of the aid from the sealing effect of the liberated external additives 3*b*. Particularly, by setting the liberation ratio of the external additives to be 2% or more, many minute holes are effectively sealed with liberated external additives, while at the same time suppressing the occurrence of filming because of intervention of liberated external additives between the toner particles and the image developing roll surface or the latent image carrier surface.

Further, by setting the sphericity of the developer particles at a range of 0.9–1 expressed in Wadell's practical sphericity according to the present invention, the developer particles can rotate and slide more freely, ensuring an effective recharging of the developer particles. As a result, developer particles existing in the non-image portion of the latent image carrier can be recovered more reliably, while preventing a scattering of image in the image portion of the latent image carrier, thus ensuring a high fidelity visualization of high definition image on the latent image carrier.

Further, by setting the peripheral speed of the image developing roll to be higher than the peripheral speed of the latent image carrier according to the present invention, developer particles can be effectively recharged by the rotating and sliding actions of the developer particles caused by the speed difference between the image developing roll and the latent image carrier in the contact region of the two rolls. In this manner, the charging level of defectively charged developer particles can be increased. As a result, developer particles existing in the non-image portion of the latent image carrier can be recovered more reliably, and the developer particles in the image portion of the latent image carrier can adhere to the right locations, preventing so-called scattering of image, which is caused by deviation of the adhering locations of developer particles.

Thus, in a developing device according to the present invention, an image developing roll can perform the foregoing three functions more reliably. As a result, a developing device according to the present invention can yield high quality images without image defects such as mottling for a long period.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

The embodiments of the present invention will be described hereinafter with reference to the drawings.

Figure 1:
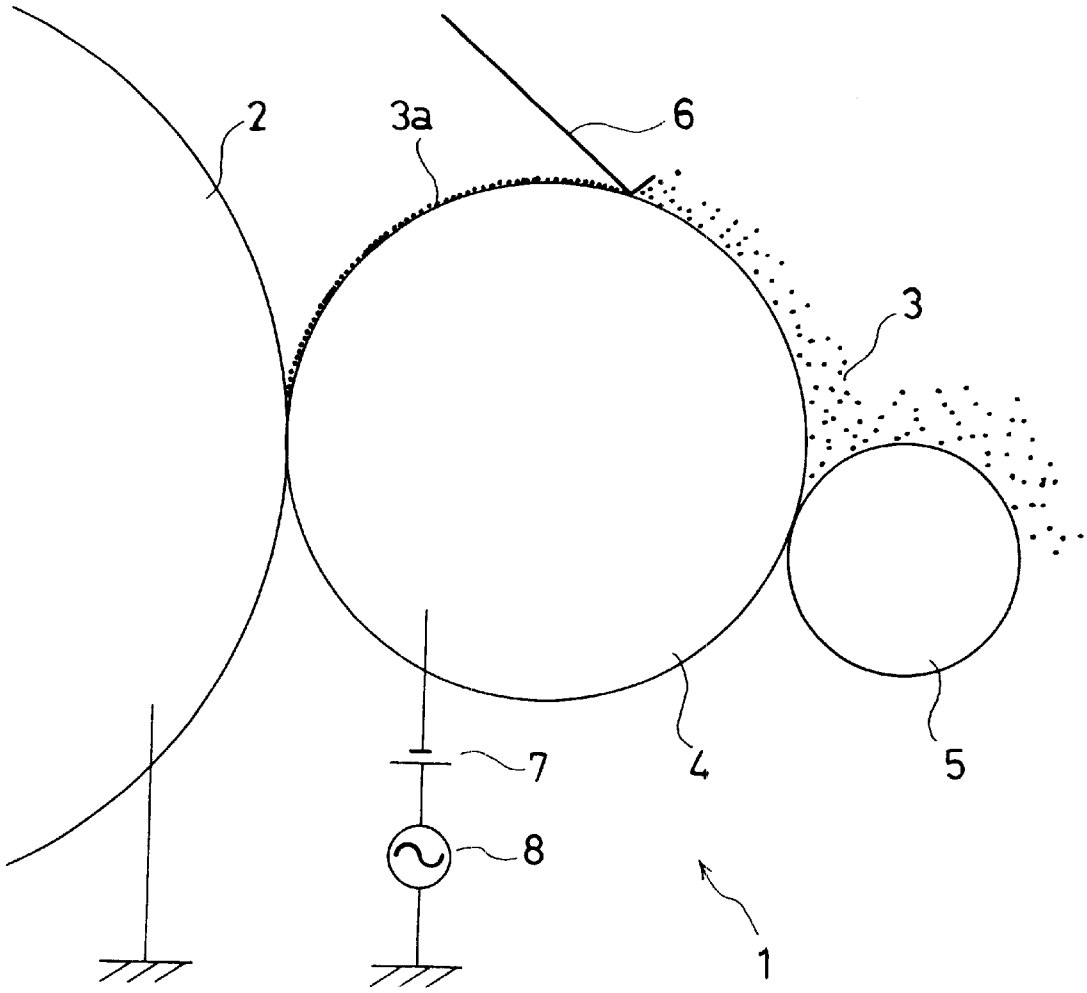
FIG. 1 is a schematic illustration of an embodiment of a developing device in accordance with the present invention.

FIG. 1 is a schematic illustration of an embodiment of a developing device in accordance with the present invention.

As shown in FIG. 1, a developing device 1 of this embodiment comprises a photoreceptor 2 which is a latent image carrier on which an electrostatic latent image is formed, an image developing roll 4 which carries toner 3 as a developer and conveys the same to the photoreceptor 2, a toner supply roll 5 which supplies toner 3 to the image developing roll 4, and a regulating member 6 which regulates toner 3 supplied from the toner supply roll 5 and conveyed by the image developing roll 4. This developing device 1 represents a contact developing system in which the image developing roll 4 is in contact with the photoreceptor 2, a peripheral speed of the image developing roll 4 being set to be higher than a peripheral speed of the photoreceptor 2 (peripheral speed ratio=peripheral speed of image developing roll/peripheral speed of photoreceptor>1). The toner supply roll 5 having a conductive or non-conductive elastic surface is in contact with the image developing roll 4, being rotationally driven at a predetermined peripheral speed ratio, while the regulating member 6 is constantly pressed against the image developing roll 4.

Figure 2:
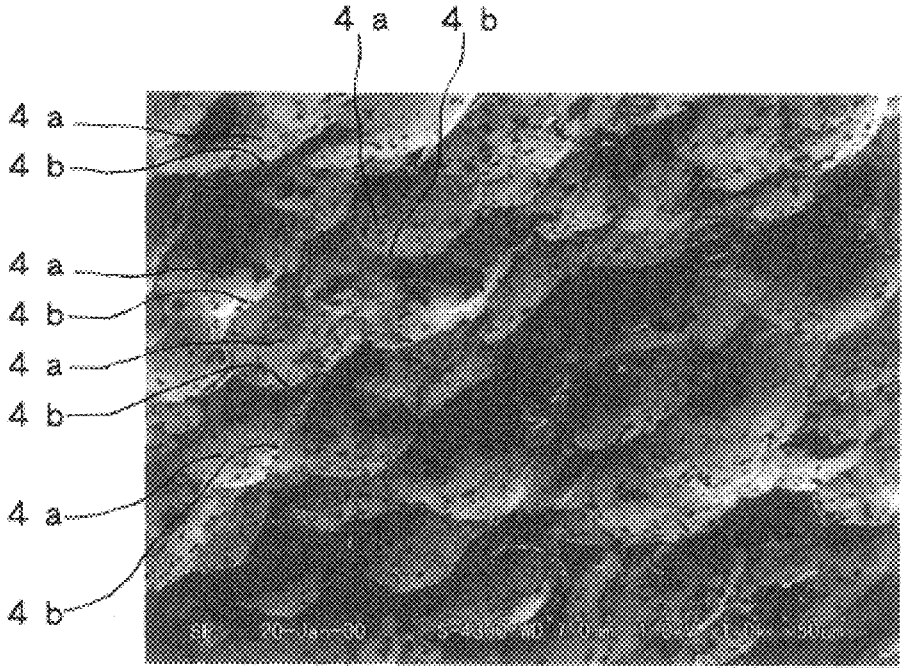
FIG. 2 is a microscopic enlarged view of surface morphology of an image developing roll formed by sand blast treatment.

The image developing roll 4 is composed of a metallic roll made of aluminum or aluminum alloy. At least a toner 3 carrying region (toner conveying region) of the metallic roll surface is treated with sand blast treatment, whereby a rough surface morphology is formed. This rough surface morphology consists of clear ridges (edges) 4*b* bounding adjacent recesses 4*a*, as shown in FIG. 2.

Further, at least sand blasted region of the metallic roll surface is treated with aluminum anodizing. During this aluminum anodizing, the electrolysis reaction penetrates into the substance of the metallic roll, forming a relatively thin oxidation layer on the metallic roll surface.

Description will now be made as regard to the formation of oxidation layer on the metallic roll surface by means of concrete examples.

As the material of the metallic roll for the image developing roll 4, aluminum or aluminum alloy is preferable. Particularly preferable are Al—Mg based aluminum alloys, of which the most preferable examples are No. 5005 and No. 5052 alloy. The Al—Mg based aluminum alloys have higher abrasion resistance as compared to the other alloys, and can maintain the surface morphology of the image developing roll 4 for a longer period, while the charging property for toner 3 is improved because of the action of Mg.

Other preferable aluminum alloys in use for the metallic roll are Al—Mn—Si based alloys, of which the most preferable are No. 6061 and No. 6063 alloys. This Al—Mn—Si based alloys also have higher abrasion resistance than other alloys and can maintain the surface morphology of the image developing roll 4 for a longer period.

In the sand blast treatment, the surface roughness and the surface morphology after the sand blast treatment are determined in such a manner as to obtain a uniform toner layer and a desired toner charging. Controlling factors for the surface roughness and the surface morphology after the sand blast treatment are type, size number, and shape of the abrasive grains. As abrasive grains, ceramic grains can be used. Among ceramic grains, particularly preferable are:

type: alumina, size number: #10–#10000, shape: irregular;

type: silicon carbide, size number: #10–8000, shape: irregular; and, type: zirconia, size number: #8–#300, shape: spherical with high sphericity.

Other preferable abrasive grains used in the sand blast treatment are glass grains. Among glass grains, particularly preferable is:

type: soda lime glass, size number: #10–#1200, shape: spherical.

Further preferable abrasive grains used in the sand blast treatment are metallic grains. Among metallic grains, particularly preferable is:

type: reduced iron, size number: #16–#150, shape: irregular.

Blasting conditions of abrasive grains such as nozzle diameter, distance between the nozzle and the work, air pressure, work revolution, and blasting time are determined depending on the type of the abrasive grains, in such a manner as to obtain an uniform toner layer formation (that is, an uniform toner conveyance) and desired toner charging. Examples of the suitable conditions are:

grain type (size number): glass beads (#300–#800);

nozzle diameter: f6–f10;

air pressure: 150–250 pKa;

work revolution: 10–30 rpm; and,.

blasting time: 20–60 sec

As anodic oxidation conditions, the following conditions are suitable when above described alloys are used:

electrolysis solution: oxalic acid $(COOH)_2$-$2H_2O$; sulfuric acid $H_2SO_4$; and, electrolysis temperature: 20° C. or less, preferably 5° C. or less Under such anodic oxidation conditions, an increased Vickers hardness and an improved abrasion resistance can be obtained.

In addition, the metallic roll is subjected to a subsequent treatment which is not regarded as sealing treatment, in which the oxidation layer is metallized by treating it in an electrolysis :solution containing metal salt. Examples of suitable subsequent treatment are:

An alternate current electrolysis in an electrolysis solution containing metal salt of Ni (or Cu, Co, Se, Sn, or the like) in which, for example, an oxidation layer formed by anodic oxidation in sulfuric acid is subjected to electrolysis in an electrolysis solution containing nickel sulfate+ammonium sulfate+boric acid with an alternate current of 10A–30A/$m^2$; or, A direct current electrolysis in an electrolysis solution containing metal salt of Ni or the like in which, for example, an oxidation layer formed by anodic oxidation in sulfuric acid is subjected to electrolysis in an electrolysis solution containing nickel sulfate+boric acid or in other electrolysis solution with a direct current.

By applying this subsequent treatment, toner charging performance is improved because of the action of Ni, which results in decrease of background toning and toner scattering.

As sealing treatment, a nickel acetate treatment is preferable. A suitable example of the nickel acetate sealing treatment is as follows:

Metallic roll is treated in a solution containing 5–5.8 g/l of nickel acetate, 1 g/l of cobalt acetate, and 8–84 g/l of boric acid with a pH value of 5–6, at a temperature of 70–90 C for a period of 15–20 minutes. By applying this nickel acetate sealing treatment, toner charging performance is improved because of the action of Ni, which results in decrease of background toning and toner scattering.

Examples

Examples of practically carried out treatment are as follows:

(1) A sand blast treatment was carried out using alumina #400 as abrasive grains and with such blasting condition as Rz=4 um, followed by aluminum anodizing. The obtained roll surface showed an uniform toner conveying property and a good toner charging property, the toner conveying capacity being maintained during a service life of the roll. In addition, a slight coloring of the image developing roll was observed, but its level was such that it did not offer any problem to the image quality.

(2) A sand blast treatment was carried out using soda lime glass #800 as abrasive grains and with such blasting condition as Rz=3 um, followed by aluminum anodizing. The obtained roll surface showed an uniform toner conveying property and a good toner charging property, the toner conveying capacity being maintained during a service life of the roll. In addition, no coloring of the image developing roll was observed.

(3) A sand blast treatment was carried out using zirconia #300 as abrasive grains and with such blasting condition as Rz=6 um, followed by aluminum anodizing. As a result, an uniform blasted surface with a spherical morphology was obtained, which showed an extremely uniform toner conveying property and a good toner charging property, the toner conveying capacity being maintained during a service life of the roll. In addition, no coloring of the image developing roll was observed.

Figure 5:
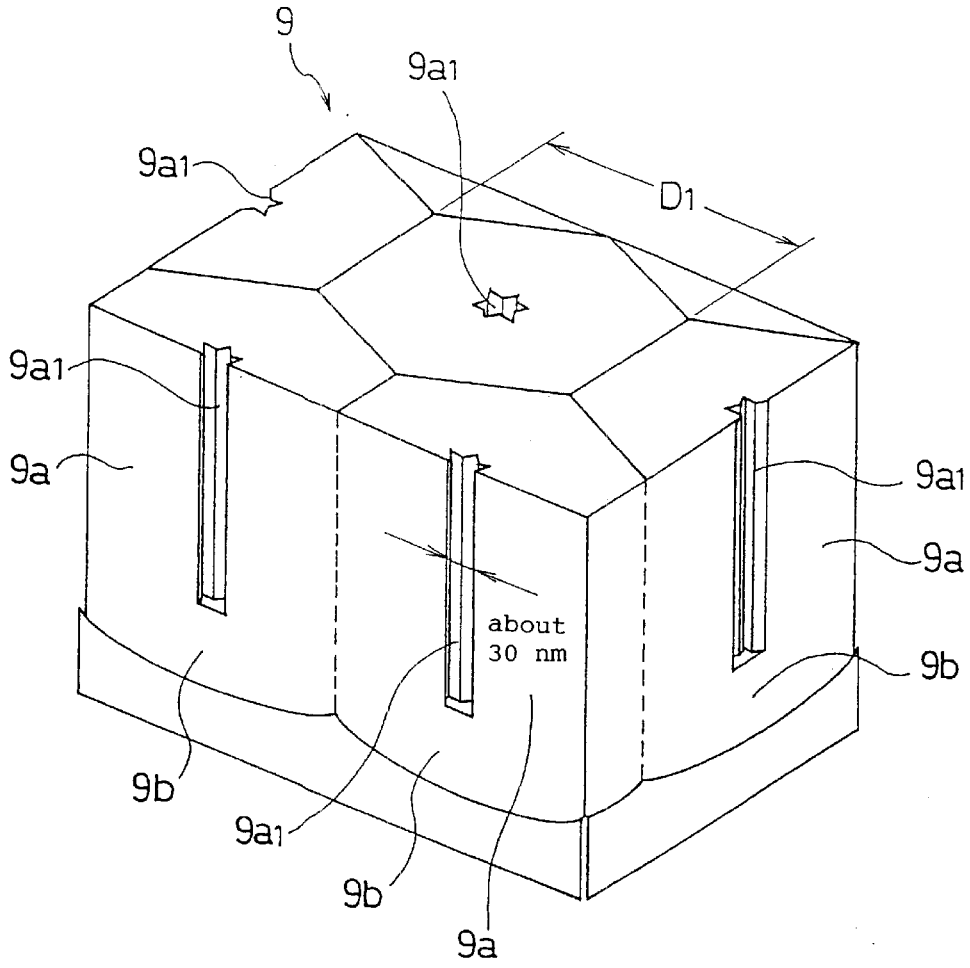
FIG. 5 is an illustration of a structure of an oxidation layer formed by aluminum anodizing.

Now, the oxidation layer 9 has a cell structure known as Keller's model, consisting of a thick porous layer 9 having many minute holes $\mathbf{9}a_1$, and a dense and very thin active layer 9*b*, as shown in FIG. 5. The minute holes $\mathbf{9}a_1$, have approximately cylindrical shape with a diameter of about 30 nm. The oxidation layer 9 as a whole has a predetermined electric resistance owing to the electrically resistant active layer 9*b*. Thus, aluminum anodizing forms an electrically resistant layer in the superficial region of a metallic roll having a relatively low electric resistance.

In addition, the oxidation layer 9 has a predetermined hardness, which imparts a predetermined hardness to the metallic roll surface. In this respect, the hardness of the surface of the image developing roll 4 can be further increased by performing the treatment slowly in an electrolysis solution kept at relatively low temperature.

Figure 3:
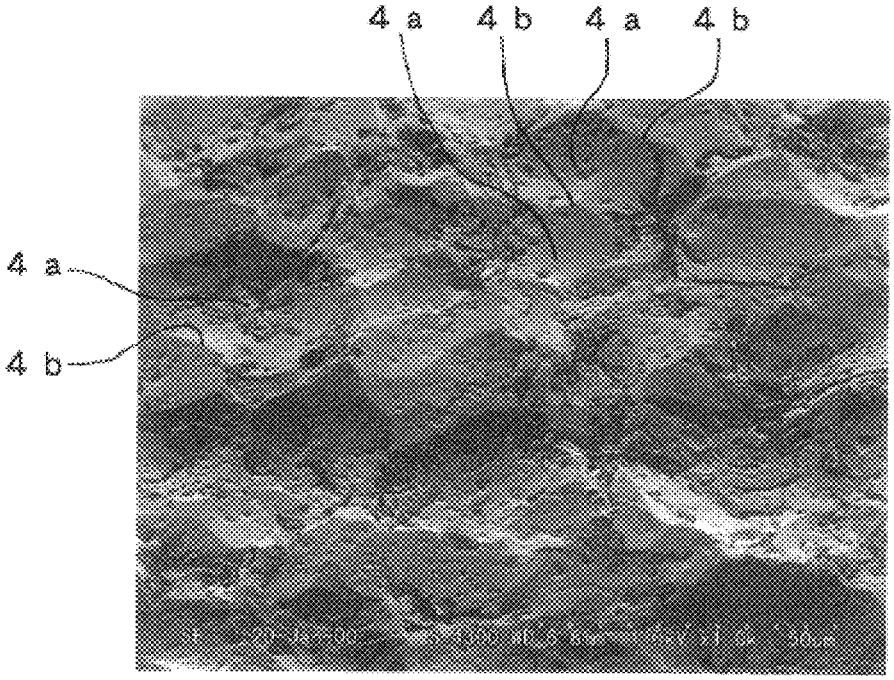
FIG. 3 is a microscopic enlarged view of surface morphology of an image developing roll after aluminum anodizing.

Further, as described before, the oxidation layer 9 formed on the roll surface by aluminum anodizing is so thin that the oxidation layer 9 hardly influences the surface morphology previously formed by the sand blast treatment. Thus, as shown in FIG. 3, the rough surface morphology formed by the sand blast treatment is mostly preserved in the surface morphology of the metallic roll after aluminum anodizing.

Figure 4:
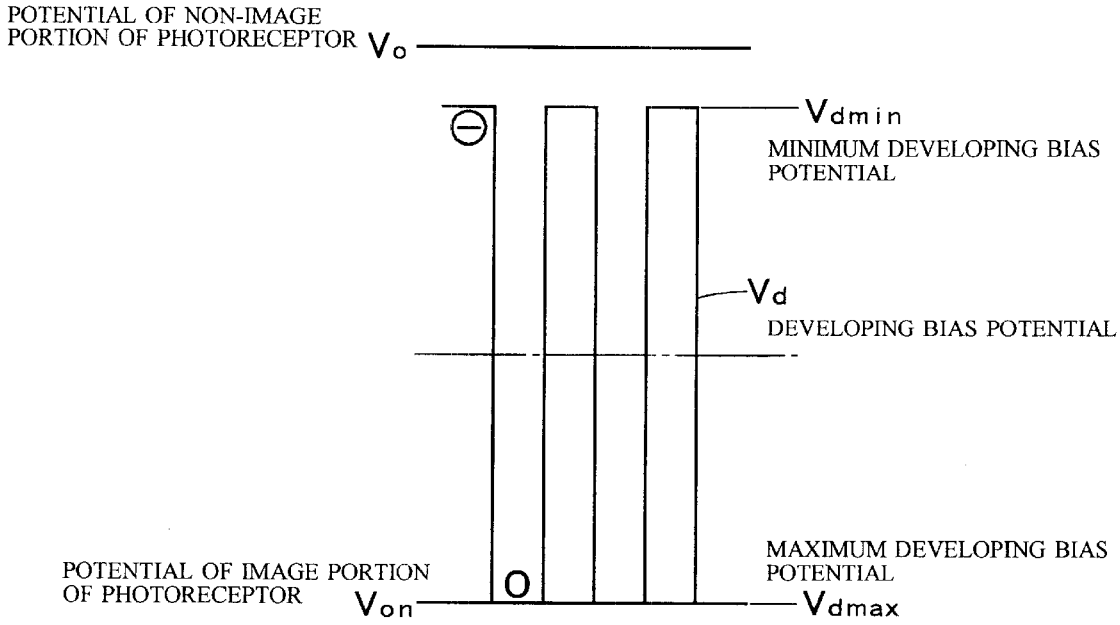
FIG. 4 is a diagram of a developing bias overlapped with alternate current voltage, to be applied to an image developing roll.

In addition, as shown in FIG. 1, a developing bias is applied to the image developing roll 4 of the developing device 1 of this embodiment, just as in conventional developing devices. In this respect, a developing bias consisting of direct current voltage from a direct current source 7 overlapped with alternate current voltage from an alternate current source 8 is applied to the developing roll 4 of the image developing device 1 of this embodiment. As shown in FIG. 4, when the potential at the image portion of the photoreceptor 2 is set at $V_{on}$ (in the shown example, at ground level, that is 0 V) and the potential at the non-image portion of the photoreceptor 2 is set at $V_o$ (in the shown example, a minus voltage), the developing bias potential $V_d$ of the developing roller 4 is set such that its maximum value $V_{dmax}$ is equal with the image portion potential $V_{on}$, while its minimum value $V_{dmin}$ is set to be higher than non-image portion potential $V_o$. Thus, the developing bias $V_d$ is set at a predetermined value which is nearer to the image portion potential $V_{on}$ with respect to the non-image portion potential $V_o$, and not on the opposite side of the image portion potential $V_{on}$ with respect to the non-image portion potential $V_o$. In this way, particles of toner 3 on the image developing roll 4 are more effectively prevented from adhering to the non-image portion of the photoreceptor 2.

Figure 6:
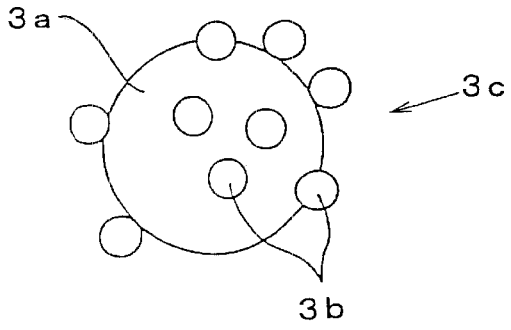
FIG. 6 is an illustration of a non-magnetic monocomponent toner particle used in the present invention.
Figure 7:
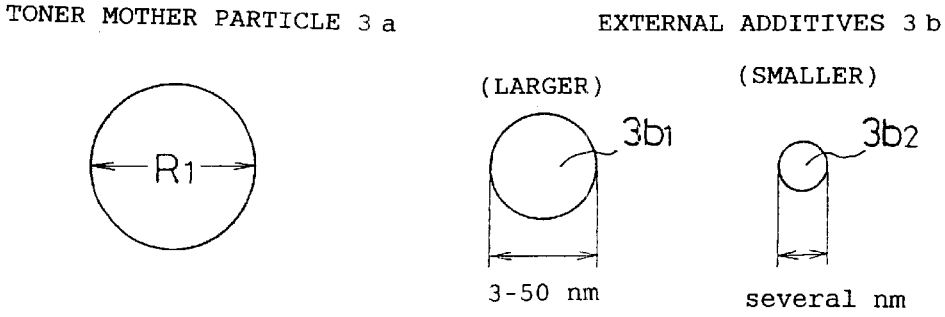
FIG. 7 is an illustration of a toner mother particle and external additives shown in FIG. 6.

As is shown in FIG. 6, toner 3 used in the developing device of this embodiment is formed as an non-magnetic monocomponent toner comprising toner particles 3*c* composed of a mother particle 3*a* consisting of relatively soft polyester resin, and external additives 3*b* consisting of relatively hard silica, adhering to the mother particle. As shown in FIG. 7, the external additives include two kinds of particles, large and small, the larger particles $\mathbf{3}b_1$, having diameters in a range of 30 to 50 nm and the smaller particles $\mathbf{3}b_2$ having diameters of several nm. Thus, the diameters of smaller particles $\mathbf{3}b_2$ are far smaller than the diameters of foregoing minute holes $\mathbf{9}a_1$ in the oxidation layer 9. Accordingly, the smaller particles $\mathbf{3}b_2$ in the external additives 3*b* can easily enter into the minute holes $\mathbf{9}a_1$, in the oxidation layer 9.

Such a non-magnetic monocomponent toner usually includes liberated external additives 3*b* which are separate from the. mother particles. According to the present invention, a liberation ratio of the external additives is set to be 2% or more. Here, the liberation ratio of external additives (EA) is obtained by the following equation:

$$\text{EA liberation ratio}=(\text{liberated EA quantity}/\text{total EA quantity})\times 100$$

In order to obtain the external additives liberation ratio, it is necessary to know the quantity of the liberated additives which are separate from the mother particles 3*a*, by analyzing the adhering state between toner mother particles 3*a* and external additives 3*b*. For this purpose, several toner analyzing methods have been known. In the image forming device 1 in this embodiment, a following method using a particle analyzer, for example, is employed.

The method is disclosed in an article "A new analyzing method for external additives—toner analysis by particle analyzer" authored by Toshiyuki Suzuki and Hisao Takahara, published in "Japan Hardcopy "97" sponsored by the Electrophotography Society on 9–11 th July, 1997.

Figure 8:
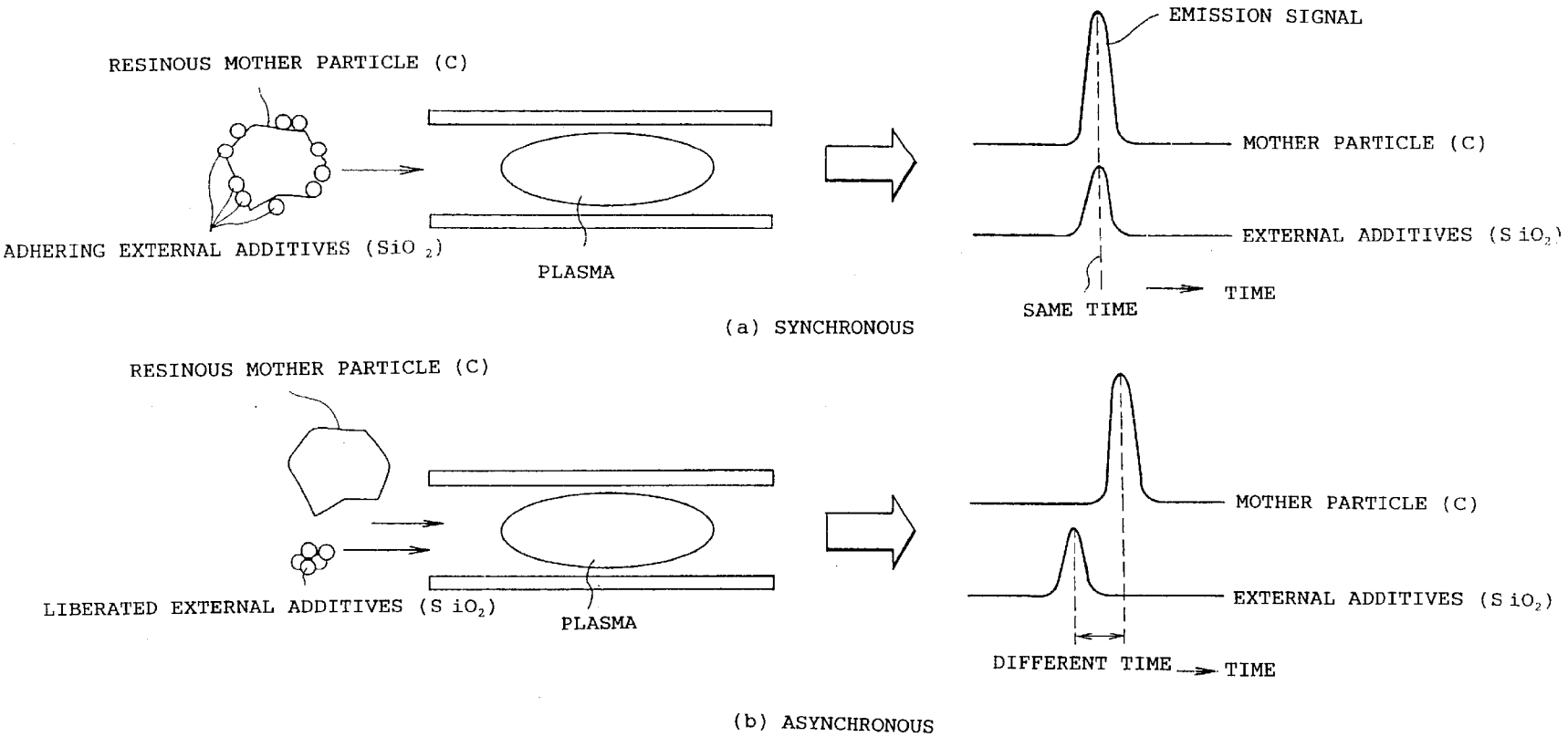
FIGS. 8(*a*) and 8(*b*) are illustrations for explaining an example of a conventional toner analysis method used in the analysis of adhering state between mother particles and external additives of toner.
Figure 9:
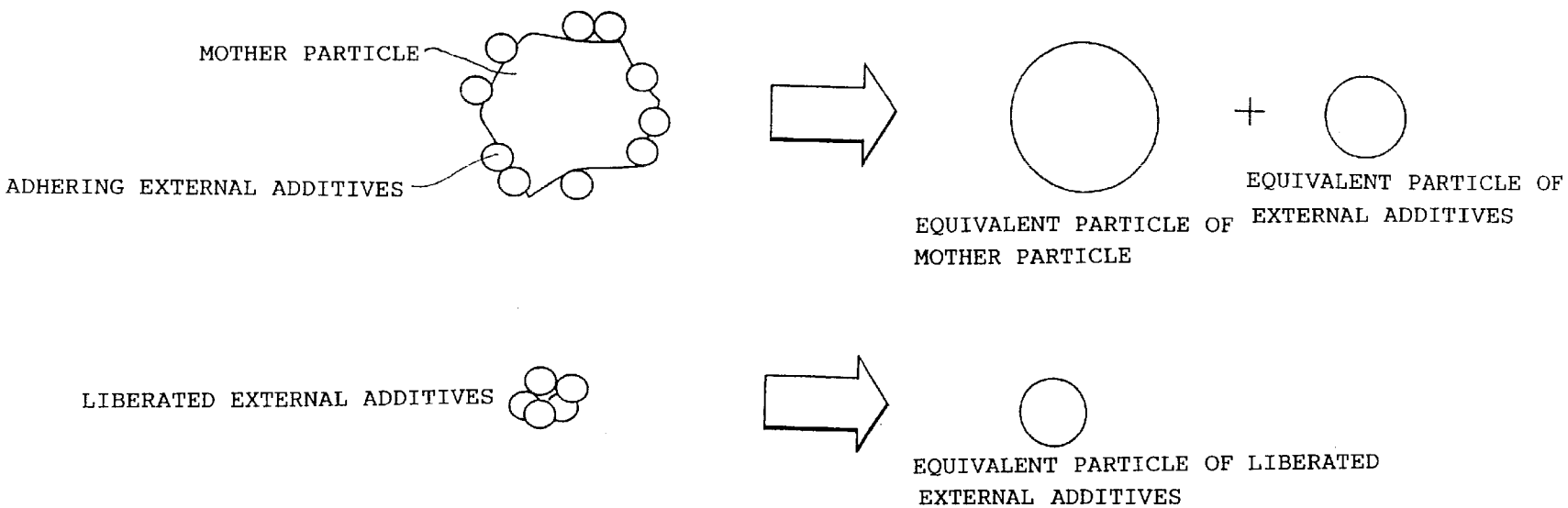
FIG. 9 is an illustration of equivalent particles and equivalent particle sizes used in the analysis method shown in FIG. 8; and, FIG. 10 is a graph showing an analysis result obtained in the toner analysis method shown in FIG. 8.

In this toner analyzing method, toner particles comprising toner mother particles consisting of resin (C) and external additives consisting of silica ($SiO_2$) adhering to the mother particles surface are introduced into a plasma in which toner particles are excited to generate emission spectrum as shown in FIGS. 8(*a*) and 8(*b*), whereby an elementary analysis is conducted.

In FIG. 8, the horizontal axis of the emission spectrum indicates the time axis. When a toner particle consisting of a resinous mother particle (C) and external additives ($SiO_2$) adhering to the former is introduced into a plasma as shown in FIG. 8(*a*), both the mother particle and external additives emit lights. In this case, the mother particle (C) and the external additives emit lights at the same time, as they are introduced into the plasma at the same time. When a mother particle (C) and external additives ($SiO_2$) emit lights at the same time, they are called to be in a synchronous state. In other words, a synchronous state of a mother particle (C) and external additives ($SiO_2$) means a state in which external additives ($SiO_2$) adhere to a mother particle (C).

On the other hand, when a mother particle (C) without external additives ($SiO_2$) and external additives ($SiO_2$) liberated from a mother particle (C) are introduced into a plasma as shown in FIG. 8(*b*), both the mother particle (C) and the external additives ($SiO_2$) emit lights just as described above. In this case however, the mother particle (C) and the external additives ($SiO_2$) emit lights at different times as the mother particle (C) and the external additives ($SiO_2$) are introduced into the plasma at different times (for instance, the mother particle emits light earlier and the external additives emit light later when the mother particle is introduced into the plasma prior to the external additives).

When a mother particle (C) and external additives ($SiO_2$) emit lights at mutually different times, they are called not to be in a synchronous state (or, to be in asynchronous state). In other words, an asynchronous state of a mother particle (C) and external additives ($SiO_2$) means a state in which external additives ($SiO_2$) do not adhere to a mother particle (C).

The height of emission signals in FIGS. 8(*a*) and 8(*b*) indicate the intensities of lights, which are in proportion not to the sizes and the shapes of particles, but to the number of atoms of the respective elements (C, $SiO_2$). In order to express the particle sizes with the emission intensities, spherical particles are supposed which consist only of mother particles (C) and external additives ($SiO_2$) respectively, whose diameters represent the diameters of mother particles (C) and external additives ($SiO_2$) respectively. This supposed spherical particles are called equivalent particles and their particle sizes are called equivalent particle sizes. Since the external additives are so small to be detected one by one, a totaled emission intensity is converted to one equivalent particle to be used in the analysis.

Figure 10:
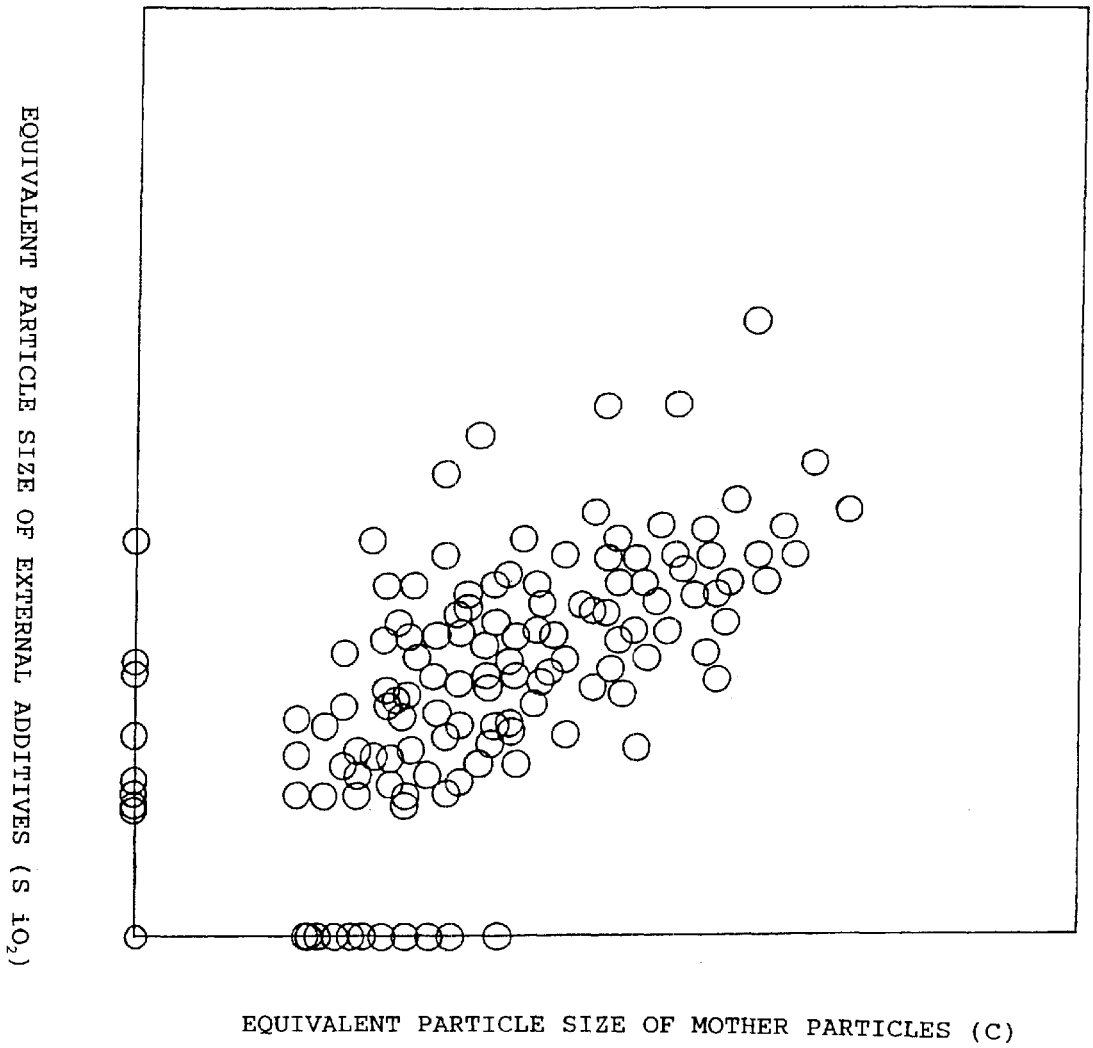

By plotting the equivalent particle sizes of the equivalent particles obtained from the emission spectrums of mother particles and external additives, an equivalent particle size distribution of a toner, as shown in FIG. 10, is obtained.

In FIG. 10, the horizontal axis indicates the equivalent particle sizes of mother particles (C) and the vertical axis indicates the equivalent particle sizes of external additives ($SiO_2$). The equivalent particles lying on the horizontal axis indicate asynchronous mother particles (C) without external additives ($SiO_2$) adhering to the former. In this respect, those mother particles (C) having external additives at a lower concentration level than predetermined are regarded as asynchronous mother particle (C), and also lie on the horizontal axis. The equivalent particles lying on the vertical axis indicate asynchronous external additives ($SiO_2$) liberated from mother particles (C). Further, the equivalent particles lying neither on horizontal nor on vertical axis indicate mother particles (C) with external additives ($SiO_2$) adhering to the former.

In this way, the adhering state of external additives ($SiO_2$) to mother particles (C) is analyzed. It should be noted that any other analyzing method than the above described particle analyzer system can be employed for the toner analysis.

Further, the surface hardness of the surface of the image developing roll 4 is set to be lower than the hardness of external additives of toner 3. More particularly, the surface hardness of the image developing roll 4 is set relative to the hardness of external additives such that the rough surface morphology of the image developing roll 4 is scraped for a certain extent, but not scraped excessively.

In addition, the sphericity of toner particles of toner 3 is set at 0.9–1 expressed in Wadell's practical sphericity, which is favorable for high fidelity visualization of high definition latent image on the latent image carrier. This Wadell's practical sphericity for toner 3 is a value expressed by a ratio between the diameter of a circle having an area equivalent with projected image area of a toner particle, and the diameter of a minimum circle circumscribing projected image of a toner particle.

The reason why the high sphericity of toner particles is favorable for high fidelity visualization of high definition latent image is disclosed in Japanese Unexamined Patent Publication No. H9-311544 by the applicant of the present invention, and will be readily understood by referring to the publication. To summarize, by giving toner particles a nearly spherical shape with a Wadell's practical sphericity of 0.9–1, the toner particles can readily form a tightly packed deposition layer when they adhere to a photoreceptor 2 depending on the potential, thus reproducing the details of latent image outline clearly and with high fidelity.

The Wadell's practical sphericity can be measured by means of an image processing device (manufactured by Apionix) providing an optical microscope, and its measuring procedure is described in above mentioned Japanese Unexamined Patent Publication No. H9-311544. As the measuring procedure should be readily understood by those skilled in the art by reference to the publication, the description for it, is here omitted.

In the developing device 1 of this embodiment with a heretofore described arrangement, toner 3 supplied by the toner supply roll 5 onto the image developing roll 4 is conveyed by the image developing roll 4 rotating counterclockwise in FIG. 1 toward the regulation member 6. Toner 3 which has reached to the regulation member 6 is regulated by the regulation member 6 for the conveyed amount to the photoreceptor 2, and excess toner is returned toward the supply roll 5. Toner 3 which has passed through the regulation member 6 forms on the image developing roll 4 a thin layer 3*d* of toner with a predetermined thickness. The thin-layered toner 3 is conveyed by the image developing roll 3 toward the photoreceptor 2, to develop a latent image on the photoreceptor 2 by forming a toner image on the photoreceptor 2.

In the developing device 1 of this embodiment, the rough morphology of the surface of the image developing roll 4 formed by sand blast treatment can be mostly preserved after aluminum anodizing. That is to say, the ridges in the rough morphology are sufficiently clear even after anodizing. The effect of clear ridges in the surface morphology of the image developing roll 4 ensure a reliable conveying of toner 3, thus improving the conveying property of the roll for toner 3.

Further, the preserving of the ridges formed in the sand blast treatment can increase the contact area between the image developing roll 4 and the toner particles 3. This in turn ensures a sufficient friction between the image developing roll 4 and toner particles 3, thereby effectively friction charging toner 3. Thus, the charging property of the roll for toner 3 can be improved.

Further, the oxidation layer formed by aluminum anodizing hardens the surface of the image developing roll 4, improving both abrasion resistance and the mechanical strength of the image developing roll 4. In this respect, the surface hardness of the image developing roll 4 can be further increased by conducting anodizing slowly in an electrolysis solution kept at a relatively low temperature.

Further, the metallic roll 4 made of aluminum having a relatively low electric resistance can be provided with an predetermined electric resistance, because of the electrically resistant layer consisting of oxidation layer formed on the roll surface by means of anodizing. The electric resistance can be obtained uniformly over the anodic oxidation treated part of the metallic roll 4, as the anodic oxidation occurs uniformly over the metallic roll surface. Thus, the image developing roll 4 can be formed easily and at a low cost from a metallic roll having an uniform and predetermined value of electric resistance, without requiring a special material originally having a predetermined electric resistance for the manufacture of the image developing roll 4.

In addition, the image developing roll 4 having an uniform and predetermined value of electric resistance can prevent the injection of excess charge from developing bias to toner 3. This effect is particularly important in a developing device I employing a contact developing system, in which a large pressure exerted by toner particles 3 nipped between the latent image carrier 2 and the image developing roll 4 promotes the injection of excess charge to toner particles 3.

Further, the hardness of the metallic roll 4 surface is set to be lower than the hardness of external additives of toner 3. Such setting of hardness brings about an effect that the rough surface of the image developing roll 4 is scraped or broken little by little by the abrasion with the external additives of toner 3, which effect suppresses the adhering of toner particles 3 onto the image developing roll 4 surface, thus preventing the occurrence of filming on the image developing roll 4. This effect is particularly important in a developing device employing a contact developing system, in which the regulating member 6 is in contact with the image developing roll 4, and toner is prone to adhere to the roll surface at the location where the regulating member 6 touches the image developing roll 4.

Moreover, the gradual scraping of ridges in the rough surface morphology of the image developing roll 4 surface can produce new ridges in the rough surface morphology of the image developing roll 4 surface.

Further, the particle diameters of the smaller particles $3b_2$ of external additives 3*b* are set to be smaller than the diameters of the minute holes $9a_1$, in the oxidation layer, so that the smaller particles $3b_2$ of external additives 3*b* can enter into the minute holes $9a_1$ to be embedded therein during toner 3 is carried and conveyed on the image developing roll 4 surface. Thus the minute holes $9a_1$ can be sealed by the liberated external additives 3*b*. In this manner, the sealing of the minute holes $9a_1$ can be achieved automatically by means of the liberated external additives 3*b* of toner 3 during the toner conveying. Accordingly, any special treatment for sealing the many minute holes $9a_1$ is not required, or even if the special sealing treatment is required, the treatment can be simplified because of the aid from the sealing effect of the liberated external additives 3*b*.

In this respect, by setting the liberation ratio of external additives to be 2% or more, many minute holes $9a_1$ can be effectively sealed with the liberated external additives 3*b*. In addition, since the intervention of the liberated external additives 3*b* between the toner particles 3 and the image developing roll 4 or photoreceptor 2 is facilitated, thereby suppressing the occurrence of filming on the image developing roll 4 or the photoreceptor 2.

Further, the sphericity of the toner particles 3 is set at a nearly spherical range of 0.9–1 expressed in Wadell's practical sphericity, so that toner particles 3 can rotate and slide more freely, thereby ensuring an effective recharging of toner 3. As a result, toner particles existing in the non-image portion of the photoreceptor 2 can be recovered more reliably, while preventing a scattering of image in the image portion of the photoreceptor 2, thus ensuring a high fidelity visualization of high fine image on the photoreceptor 2.

Further, the fact that the sphericity of toner 3 is high means that the shapes of the liberated external additives 3*b* are substantial sphere, thus ensuring smooth embedding of the liberated external additives 3*b* into the minute holes $9a_1$ in the oxidation layer 9. Thus, the sealing treatment of the minute holes $9a_1$ can be achieved more reliably.

Further, the hardness of the metallic roll 4 surface is set to be lower than the hardness of external additives of toner 3. Such setting of hardness brings about an effect that the rough surface of the image developing roll 4 is scraped or broken little by little by the friction with the external additives of toner 3, reliably scraping off toner 3 adhering onto the image developing roll 4. In this manner, the adhering of toner 3 onto the image developing roll 4 can be suppressed to prevent the occurrence of filming on the image developing roll 4, while providing the rough surface with new ridges formed by scraping off of old ridges.

Further, the peripheral speed of the image developing roll 4 is set to be higher than the peripheral speed of the photoreceptor 2, so that toner particles 3 are effectively recharged by the rotating and sliding actions of the toner particles 3 caused by the speed difference between the rolls in the developing region where the image developing roll 4 is in contact with the photoreceptor 2. In this manner, the charge of the defectively charged toner particles can be increased. As a result, toner particles 3 adhering to the non-image portion of the photoreceptor 2 can be recovered more reliably to the image developing roll 4, while in the image portion, toner particles 3 can reliably adhere to the right locations preventing so-called image scattering caused by deviation of adhering locations of toner particles 3.

Further, as a developing bias consisting of a direct current voltage overlapped with an alternate current voltage is applied to the image developing roll 4, the discharging of the developing bias from the developing roll 4 can be prevented by suitably controlling the developing bias. Particularly, by setting the maximum potential of the developing bias to be lower than the potential set at the non-image portion of the photoreceptor 2, the discharging of the developing bias is effectively prevented, while also preventing the background toning caused by the toner particles 3 adhering to the non-image area of the photoreceptor 2.

In addition, by overlapping the direct current voltage with the alternate current voltage, a suitable edge effect can be rendered to the image and an uniform gray scale can be reproduced, improving the gradation.

Thus, the image developing roll 4 of the developing device 1 of this embodiment can perform the foregoing three functions more reliably. Accordingly, the developing device 1 of this embodiment can yield high quality image without image defects such as mottling for a long period.

The present invention has been described with reference to an embodiment of developing device 1 in which the present invention is applied to a contact developing system. The present invention is not limited however to the described embodiment but can be applied to any developing device as long as it comprises the image developing roll 4, including a non-contact system developing device in which the image developing roll 4 is not in contact with the photoreceptor 2, and a developing device in which the regulating member 6 is not in contact with the image developing roll 4. Particularly, when the present invention is applied to a non-contact system developing device, the toner conveying property and the toner charging property can be improved, decreasing the toner scattering.

What is claimed is:

1. A developing device comprising at least: an image developing roll which carries a developer on the surface thereof and conveys said developer to a latent image carrier; and a regulating member which regulates the developer to be conveyed to the latent image carrier to form a thin layer of the developer on the image developing roll, wherein said image developing roll is composed of a metallic roll having a rough surface morphology formed by sand blast treatment at least in a developer carrying region of the surface thereof, and anodizing is applied at least to the part of the surface where the rough surface morphology is formed, said developer comprises toner particles on which external additives with a predetermined hardness are attached, and said metallic roll has a surface hardness which is set to be lower than the hardness of said external additives.

2. The developing device as claimed in claim 1, wherein the particle diameter of said external additive particles is set to be smaller than the diameter of minute holes existing in an oxidation layer formed by said anodizing.

3. The developing device as claimed in claim 1, wherein the liberation ratio of said external additives is set to be 2% or more.

4. The developing device as claimed in claim 1, wherein the sphericity of said developer particles expressed in Wadell's practical sphericity is set at 0.9–1.

5. The developing device as claimed in claim 1, wherein the peripheral speed of said image developing roll is set to be higher than the peripheral speed of said latent image carrier.

6. The developing device as claimed in claim 1, wherein said developing device employs a contact development system.

7. The developing device as claimed in claim 1 or 6, wherein said developer is non-magnetic monocomponent toner.

8. The developing device as claimed in claim 7, wherein the particle diameter of said external additive particles is set to be smaller than the diameter of minute holes existing in an oxidation layer formed by said anodizing.

9. The developing device as claimed in claim 8, wherein the liberation ratio of said external additives is set to be 2% or more.

10. The developing device as claimed in claim 9, wherein the sphericity of said developer particles expressed in Wadell's practical sphericity is set at 0.9–1.

11. The developing device as claimed in claim 10, wherein the peripheral speed of said image developing roll is set to be higher than the peripheral speed of said latent image carrier.

* * * * *